US008317947B2

(12) United States Patent
Asano et al.

(10) Patent No.: US 8,317,947 B2
(45) Date of Patent: Nov. 27, 2012

(54) ALUMINUM ALLOY SHEET FOR PRESS FORMING

(75) Inventors: Mineo Asano, Tokyo (JP); Hidetoshi Uchida, Tokyo (JP)

(73) Assignee: Sumitomo Light Metal Industries, Ltd., Tokyo (JP)

( * ) Notice: Subject to any disclaimer, the term of this patent is extended or adjusted under 35 U.S.C. 154(b) by 193 days.

(21) Appl. No.: 12/664,080

(22) PCT Filed: May 29, 2008

(86) PCT No.: PCT/JP2008/059897

§ 371 (c)(1),
(2), (4) Date: Dec. 11, 2009

(87) PCT Pub. No.: WO2008/152919

PCT Pub. Date: Dec. 18, 2008

(65) Prior Publication Data

US 2010/0183899 A1 Jul. 22, 2010

(30) Foreign Application Priority Data

Jun. 11, 2007 (JP) ..... 2007-154270
May 21, 2008 (JP) ..... 2008-132849

(51) Int. Cl.
*C22C 21/00* (2006.01)

(52) U.S. Cl. ..... 148/415; 148/440; 148/437; 420/544; 420/553

(58) Field of Classification Search ..... 148/415, 148/440, 437; 420/544, 553
See application file for complete search history.

(56) References Cited

U.S. PATENT DOCUMENTS

| | | | | |
|---|---|---|---|---|
| 4,511,409 | A | 4/1985 | Ferton et al. | |
| 5,490,885 | A * | 2/1996 | Miller et al. | 148/564 |
| 6,736,911 | B1 | 5/2004 | Ro et al. | |
| 2004/0187985 | A1 * | 9/2004 | Matsumoto et al. | 148/692 |

FOREIGN PATENT DOCUMENTS

| | | |
|---|---|---|
| CA | 2 519 390 A1 | 10/2004 |
| JP | 50 133912 | 10/1975 |
| JP | 61 170548 | 8/1986 |
| JP | 4 504141 | 7/1992 |
| JP | 8-325663 | 12/1996 |
| JP | 2000 17414 | 1/2000 |
| JP | 2000 319741 | 11/2000 |
| JP | 2004-250738 | 9/2004 |
| WO | 01 04369 | 1/2001 |
| WO | WO 2004/090185 A1 | 10/2004 |

* cited by examiner

*Primary Examiner* — Roy King
*Assistant Examiner* — Janelle Morillo
(74) *Attorney, Agent, or Firm* — Oblon, Spivak, McClelland, Maier & Neustadt, L.L.P.

(57) ABSTRACT

The present invention provides an aluminum alloy sheet for press forming, having the crystallo-graphic texture in which the orientation density of CR orientation ({001}<520>) is higher than that of any orientation other than the CR orientation. The orientation density of the CR orientation is preferably 10 or more (random ratio). The orientation densities of all orientations other than the CR orientation are preferably less than 10. The aluminum alloy sheet is preferably made of an Al—Mg—Si alloy.

6 Claims, 1 Drawing Sheet

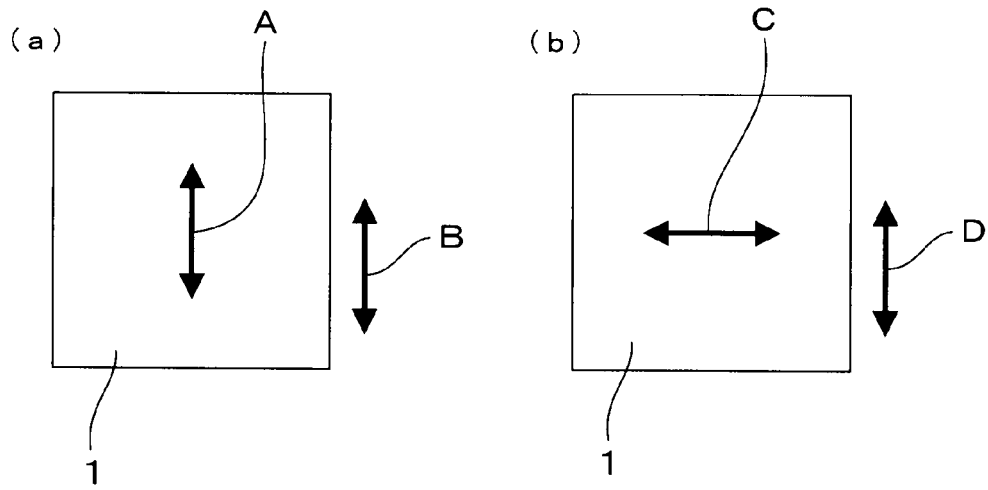
(a)
A
B
1
(b)
C
D
1

ALUMINUM ALLOY SHEET FOR PRESS FORMING

TECHNICAL FIELD

The present invention relates to an aluminum alloy sheet for press forming which is excellent in press formability and suitable for, in particular, automobile parts such as an automobile body panel.

BACKGROUND ART

Hitherto, it has been suggested that a crystallo-graphic texture or the like of an aluminum alloy sheet is controlled in accordance with a type of press forming (for example, deep-drawing formability, stretch-formability, and bendability) to enhance the formability of the aluminum alloy sheet when the aluminum alloy sheet is press formed.

For example, it has been suggested that the crystallo-graphic texture of an Al—Mg—Si based aluminum alloy sheet can be improved to match with press formability by controlling at least the orientation density of Cube orientation in accordance with a type of press forming (Patent Document 1).

However, the press forming of an automobile body panel or the like involves combination of the press forming types mentioned above. Therefore, in order to improve the formability of the automobile body panel when the automobile body panel is press formed, it is necessary to improve a rupture limit (enhance rupture limit strain) in an equibiaxial deformation, a plane strain deformation, and a uniaxial deformation of a material.

[Patent Document 1] Japanese Patent Application Laid-Open No. 2000-319741

DISCLOSURE OF THE INVENTION

Problem to be Solved by the Invention

The present invention has been made in view of the above conventional problem, and an object of the present invention is to provide an aluminum alloy sheet for press forming which has an enhanced rupture limit in the equibiaxial deformation, the plane strain deformation, and the uniaxial deformation and is suitable for press forming.

Means for Solving the Problem

The present invention is based on an aluminum alloy sheet for press forming, characterized by including, a crystallo-graphic texture in which the orientation density of CR orientation ({001}<520>; the same shall apply hereinafter) is higher than that of any orientation other than the CR orientation.

In the crystallo-graphic texture of the aluminum alloy sheet for press forming, the orientation density of the CR orientation is higher than that of any orientation other than the CR orientation. This can improve a rupture limit in the equibiaxial deformation, the plane strain deformation, and the uniaxial deformation of a material required in order to improve press formability as known from examples to be described later.

Thus, the present invention can enhance the rupture limit in the equibiaxial deformation, the plane strain deformation, and the uniaxial deformation to obtain the aluminum alloy sheet which is suitable for press forming.

BRIEF DESCRIPTION OF THE DRAWINGS

FIG. 1 is an illustration showing a cold rolling direction with respect to a hot rolling direction in Examples 1 to 3.

BEST MODE FOR CARRYING OUT THE INVENTION

As described above, the aluminum alloy sheet for press forming of the present invention has a crystallo-graphic texture such that the orientation density of CR orientation is higher than that of any orientation other than the CR orientation.

Herein, the crystallo-graphic texture of an aluminum alloy will be described. Polycrystal materials such as the aluminum alloy often have a structure where crystal grains are orientated in some specific orientations, that is, a crystallo-graphic texture. Examples of the orientations include CR orientation, Cube orientation, Goss orientation, Brass orientation, S orientation, Copper orientation, RW orientation and PP orientation.

When crystal orientations are uniformly dispersed and are not accumulated, the crystallo-graphic texture is random.

It is known that a change in volume fraction of the crystallo-graphic texture results in a change in plastic anisotropy.

The manner in which the crystallo-graphic texture is produced varies according to the processing method thereof even in the case of the same crystal system. In the case of the crystallo-graphic texture of a sheet material by rolling, the manner is represented by a rolling plane and a rolling direction. The rolling plane is expressed as Miller index (hkl) representing a plane, and the rolling direction is expressed as Miller index [uvw] representing a direction (h, k, l, u, v and w are integers). 24 kinds of equivalent orientation groups obtained by reversing the orders of h, k, l and u, v, w are collectively represented as {h, k, l}<u, v, w> so as to meet the condition of hu+kv+lw=0, and {h, k, l}<u, v, w> is the general indication of orientation.

The orientations are respectively shown as follows based on the expression method.

CR orientation: {001}<520>
Cube orientation: {001}<100>
Goss orientation: {011}<100>
Brass orientation: {011}<211>
S orientation: {123}<634>
Copper orientation: {112}<111>
RW orientation: {001}<110>
PP orientation: <{011}<122>

The orientation density of the crystallo-graphic texture is represented by a ratio of each orientation intensity with respect to random orientation.

In the present invention, it is defined that deviations from these orientations by ±10 degrees or less belong to the same orientation. However, it is defined that for the Copper orientation and the S orientation, deviations from these orientations by ±9 degrees or less belong to the same orientation.

The distribution of the orientation density can be measured by determining a crystal grain orientation distribution function (ODF) using, for example, an X-ray diffraction method.

Specifically, the orientation density of each of crystal orientations is determined by determining the ODF according to three-dimensional orientation analysis from a pole figure measured by an X-ray diffractometer. The ODF is calculated by a series expansion method proposed by Bunge, in which the expansion order of even-numbered terms is 22 and the expansion order of odd-numbered terms is 19. The orientation density is represented by a ratio of the orientation density of specific orientation to that of a sample having random orientation and denoted as a random ratio. Random strength Ir is calculated by means of the following equation from specimen sample strength Ic.

$$Ir[\alpha, \beta] = \sum_{\alpha=0}^{90} \sum_{\beta=0}^{360-\Delta s} Ic[\alpha, \beta] \times \cos\alpha \Big/ \sum_{\alpha=0}^{90} \sum_{\beta=0}^{360-\Delta s} \cos\alpha \quad \text{[Equation 1]}$$

Wherein α and β are measured angles, and Δs is a step angle.

A method for manufacturing the aluminum alloy is not particularly limited as long as the aluminum alloy sheet for press forming, which has such a crystallo-graphic texture that the orientation density of the CR orientation is higher than that of any orientation other than the CR orientation, can be obtained. Examples thereof include a method for hot rolling an ingot made of an aluminum alloy, then cold rolling the hot-rolled product in the 90° direction with respect to the rolling direction of hot rolling, and further subjecting the cold-rolled product to solid solution treatment and quenching, followed by heat treatment. In the future, there is sufficient possibility that a method for more efficiently manufacturing the aluminum alloy sheet for press forming emerges.

In the aluminum alloy sheet for press forming, the orientation density of the CR orientation is preferably 10 or more (random ratio; the same shall apply hereinafter).

In this case, particularly, a rupture limit in the equibiaxial deformation, the plane strain deformation, and the uniaxial deformation is enhanced.

When the orientation density of the CR orientation is less than 10, the rupture limit in each of the deformations may be decreased to deteriorate the formability.

The orientation densities of all orientations other than the CR orientation are preferably less than 10.

In this case, particularly, the rupture limit in the equibiaxial deformation, the plane strain deformation, and the uniaxial deformation is enhanced.

Examples of orientations other than the CR orientation include the Cube orientation, the Goss orientation, the Brass orientation, the S orientation, the Copper orientation, the RW orientation and the PP orientation.

When even any one of the orientation densities of the orientations other than the CR orientation exceeds 10, the rupture limit in each of the deformations may be decreased to deteriorate the formability.

The aluminum alloy sheet for press forming is preferably made of an Al—Mg—Si alloy.

In this case, particularly, the aluminum alloy sheet can be used as a material suitable for an engine hood, trunk hood, or the like of an automobile, for which stretch-formability and bendability are required, or suitable for an automobile door, fender, or the like, for which deep-drawing formability is required.

It is preferable that the Al—Mg—Si alloy having particularly preferred components includes: 0.2% to 2.0% of Si (mass %; the same shall apply hereinafter); 0.2% to 1.5% of Mg; at least one of 1.0% of Cu, 0.5% of Zn, 0.5% or less of Fe, 0.3% of Mn, 0.3% of Cr, 0.2% or less of V, 0.15% of Zr, 0.1% of Ti and 0.005% or less of B; and the balance consisting of inevitable impurities and aluminum.

Si is necessary to obtain bake hardenability, and functions to form Mg—Si compounds such as $Mg_2Si$ to increase strength.

If the Si content is less than 0.2%, sufficient bake hardenability may not be obtained by heat treatment where temperature is maintained in the range of 150° C. to 200° C. for 10 to 60 minutes. On the other hand, if the Si content exceeds 2.0%, proof stress during forming becomes high to cause a problem that spring back becomes larger, in which the shape of a material is restored (a material is elastically restored) by an elastic deformation amount due to demolding. The formability may be deteriorated. If the Si content is less than 0.2% or exceeds 2.0%, the orientation density of the CR orientation tends to be decreased, and the formability may be deteriorated.

The Si content is more preferably 0.8 to 1.2%.

The aluminum alloy sheet for press forming includes 0.2 to 1.5% of Mg.

Mg is necessary to obtain bake hardenability in the same manner as Si as described above, and functions to form Mg—Si compounds such as $Mg_2Si$ to increase strength.

If the Mg content is less than 0.2%, sufficient bake hardenability may not be obtained by heat treatment where temperature is maintained in the range of 150° C. to 200° C. for 10 to 60 minutes. On the other hand, if the Mg content exceeds 1.5%, proof stress after solid solution treatment or final heat treatment may become high to cause larger spring back. If the Mg content is less than 0.2% or exceeds 1.5%, the orientation density of the CR orientation tends to be decreased, and the formability may be deteriorated.

The Mg content is more preferably 0.3 to 0.7%.

The aluminum alloy sheet for press forming further includes at least one of 1.0% of Cu, 0.5% of Zn, 0.5% or less of Fe, 0.3% of Mn, 0.3% of Cr, 0.2% or less of V, 0.15% of Zr, 0.1% of Ti and 0.005% or less of B.

Cu functions to increase strength and enhance formability.

If the Cu content exceeds 1.0%, corrosion resistance may be deteriorated.

Zn functions to enhance zinc phosphate treatment properties during surface treatment. If the Zn content exceeds 0.5%, corrosion resistance may be deteriorated.

Fe, Mn, Cr, V and Zr function to increase strength and refine crystal grains to prevent occurrence of orange peel surfaces during forming. If the contents of Fe, Mn, Cr, V and Zr exceed the ranges described above, the orientation density of the CR orientation tends to be decreased, and the formability may be deteriorated.

Ti and B function to refine a cast structure to enhance formability. If the contents of Ti and B exceed the ranges described above, the orientation density of the CR orientation tends to be decreased, and the formability may be deteriorated.

The aluminum alloy sheet for press forming may be made of an Al—Mg alloy.

In this case, particularly, the aluminum alloy sheet can be used as a material suitable for an engine hood, trunk hood, or the like of an automobile, for which stretch-formability and bendability are required, or suitable for an automobile door, fender, or the like, for which deep-drawing formability is required.

It is preferable that the Al—Mg alloy having particularly preferred components includes: 1.5 to 6.5% (mass %; the same shall apply hereinafter) of Mg; at least one of 1.5% of Mn, 0.7% of Fe, 0.5% of Si, 0.5% of Cu, 0.5% or less of Cr, 0.4% of Zn, 0.3% of Zr, 0.2% or less of V, 0.2% of Ti and 0.05% of B; and the balance consisting of inevitable impurities and aluminum.

Mg is necessary to obtain strength, and functions to form a solid solution to increase strength. If the Mg content is less than 1.5%, sufficient strength cannot be obtained, and the formability may be deteriorated. On the other hand, if the Mg content exceeds 6.5%, cracking easily occurs during hot rolling to cause a problem that it is impossible to roll. If the Mg content is less than 1.5% or exceeds 6.5%, the orientation density of the CR orientation tends to be decreased, and the formability may be deteriorated. The Mg content is more preferably 2.2 to 6.2%.

The aluminum alloy sheet for press forming further includes at least one of 1.5% of Mn, 0.7% of Fe, 0.5% or less of Si, 0.5% of Cu, 0.5% of Cr, 0.4% or less of Zn, 0.3% of Zr, 0.2% of V, 0.2% of Ti and 0.05% of B. Mn, Fe, Si, Cu, Cr, Zn, Zr and V function to increase strength and enhance formability. If the contents of Mn, Fe, Si, Cu, Cr, Zn, Zr and V exceed the ranges described above, the orientation density of the CR orientation tends to be decreased, and the formability may be deteriorated. Ti and B function to refine a cast structure to enhance formability. If the contents of Ti and B exceed the ranges described above, the orientation density of the CR orientation tends to be decreased, and the formability may be deteriorated.

The aluminum alloy sheet for press forming may be made of an Al—Mn alloy.

In this case, particularly, the aluminum alloy sheet can be used as a material suitable for a heat insulator or the like of an automobile for which both stretch-forming and deep-drawing forming are required.

It is preferable that the Al—Mn alloy having particularly preferred components includes: 0.3 to 2.0% of Mn (mass %; the same shall apply hereinafter); at least one of 1.5% of Mg, 1.0% of Si, 1.0% of Fe, 0.5% of Cu, 0.5% of Cr, 0.5% of Zn, 0.5% of Zr, 0.2% or less of V, 0.2% of Ti and 0.05% of B; and the balance consisting of inevitable impurities and aluminum.

Mn is necessary to obtain strength, and it functions to form an Al—Mn compound to enhance strength. If the Mn content is less than 0.3%, sufficient strength cannot be obtained, and the formability may be deteriorated. On the other hand, if the Mn content exceeds 2.0%, coarse crystals may tend to be formed during casting, and the formability may be deteriorated. If the Mn content is less than 0.3% or exceeds 2.0%, the orientation density of the CR orientation tends to be decreased, and the formability may be deteriorated. The Mn content is more preferably 0.8 to 1.5%.

The aluminum alloy sheet for press forming further includes at least one of 1.5% of Mg, 1.0% of Si, 1.0% or less of Fe, 0.5% of Cu, 0.5% of Cr, 0.5% or less of Zn, 0.5% of Zr, 0.2% of V, 0.2% of Ti and 0.05% of B. Mg, Si, Fe, Cu, Cr, Zn, Zr and V function to increase strength and enhance formability. If the contents of Mg, Si, Fe, Cu, Cr, Zn, Zr and V exceed the ranges described above, the orientation density of the CR orientation tends to be decreased, and the formability may be deteriorated. Ti and B function to refine a cast structure to enhance formability. If the contents of Ti and B exceed the ranges described above, the orientation density of the CR orientation tends to be decreased, and the formability may be deteriorated.

EXAMPLES

Example 1

In this example, aluminum alloy sheets for press forming (Samples E1 to E10 and Samples C1 to C10) were manufactured as examples of the aluminum alloy sheets of the present invention and comparative examples. The examples illustrate one embodiment of the present invention, which should not be construed as limiting the present invention.

Hereinafter, this will be described in detail.

A method for manufacturing the aluminum alloy sheet for press forming will be described.

First, alloys (Alloy A to Alloy J) having respective compositions shown in Table 1, in each of which the balance consisted of inevitable impurities and aluminum, were made into ingots by a semi-continuous casting process referred to as a DC casting process (Direct Chill Casting Process). The obtained ingots were homogenized at 550° C. for 6 hours and then cooled to room temperature.

TABLE 1

| | composition (mass %) | | | | | | | | | | |
|---|---|---|---|---|---|---|---|---|---|---|---|
| | Si | Mg | Cu | Zn | Fe | Mn | Cr | V | Zr | Ti | B |
| alloy A | 1.00 | 0.58 | 0.01 | — | 0.12 | 0.10 | — | — | — | 0.03 | 0.0005 |
| alloy B | 0.89 | 1.20 | — | 0.02 | 0.16 | 0.07 | — | — | — | 0.02 | 0.0005 |
| alloy C | 1.60 | 0.35 | 0.02 | 0.01 | 0.12 | 0.10 | — | — | — | 0.02 | 0.0005 |
| alloy D | 1.00 | 0.41 | 0.77 | — | 0.13 | 0.09 | — | — | — | 0.02 | 0.0006 |
| alloy E | 1.00 | 0.54 | — | 0.24 | 0.16 | 0.11 | — | — | — | 0.03 | 0.0005 |
| alloy F | 1.00 | 0.46 | 0.01 | — | 0.26 | 0.03 | — | — | — | 0.02 | 0.0007 |
| alloy G | 1.00 | 0.62 | 0.01 | 0.02 | 0.12 | 0.23 | — | — | — | 0.02 | 0.0005 |
| alloy H | 1.10 | 0.58 | — | 0.01 | 0.16 | 0.04 | 0.08 | — | — | 0.02 | 0.0005 |
| alloy I | 1.00 | 0.47 | 0.02 | — | 0.14 | 0.06 | — | 0.05 | — | 0.03 | 0.0005 |
| alloy J | 1.10 | 0.52 | — | 0.01 | 0.16 | 0.12 | — | — | 0.06 | 0.01 | 0.0007 |

Next, the ingots were reheated to 420° C. and hot rolling was started to obtain 4.0 mm-thick hot-rolled sheets. The finishing temperature of the hot rolling was 250° C.

Subsequently, the hot-rolled sheets were cold-rolled in the 0° direction (arrow B) with respect to the hot rolling direction (arrow A) as shown in FIG. 1(*a*) or in the 90° direction (arrow D) with respect to the hot rolling direction (arrow C) as shown in FIG. 1(*b*) to obtain 1.0 mm-thick cold-rolled sheets.

The cold-rolled sheets were further subjected to a solid solution treatment at 540° C. for 20 seconds and quenched to room temperature at a cooling rate of 30° C./s.

At 3 minutes after quenching, heat treatment was performed at 100° C. for 1 hour. Thereby, the aluminum alloy sheets for press forming (Samples E1 to E10 and Samples C1 to C10) were obtained.

Tables 2 and 3 show the types of alloys used and the cold rolling directions with respect to the hot rolling directions, for Samples E1 to E10 and Samples C1 to C10 described above.

TABLE 2

| sample | alloy | cold rolling direction with respect to hot rolling direction (°) | orientation density of each of crystal orientations (random ratio): CR orientation | orientations other than CR orientation and orientation density | formability: equibiaxial deformation | plane strain deformation | uniaxial deformation | evaluation | proof stress (MPa) |
|---|---|---|---|---|---|---|---|---|---|
| E1 | alloy A | 90 | 20 | Cube orientation, 2 | 0.46 | 0.36 | 0.42 | ○ | 129 |
| E2 | alloy B | 90 | 14 | Cube orientation, 2 | 0.43 | 0.32 | 0.41 | ○ | 135 |
| E3 | alloy C | 90 | 16 | Cube orientation, 2 | 0.42 | 0.32 | 0.41 | ○ | 145 |
| E4 | alloy D | 90 | 10 | Cube orientation, 4 | 0.43 | 0.31 | 0.40 | ○ | 130 |
| E5 | alloy E | 90 | 21 | Cube orientation, 3 | 0.45 | 0.35 | 0.42 | ○ | 126 |
| E6 | alloy F | 90 | 15 | Cube orientation, 2 | 0.44 | 0.32 | 0.42 | ○ | 130 |
| E7 | alloy G | 90 | 12 | Goss orientation, 2 | 0.42 | 0.31 | 0.40 | ○ | 133 |
| E8 | alloy H | 90 | 14 | Cube orientation, 2 | 0.42 | 0.31 | 0.40 | ○ | 127 |
| E9 | alloy I | 90 | 17 | Cube orientation, 2 | 0.45 | 0.35 | 0.42 | ○ | 125 |
| E10 | alloy J | 90 | 16 | PP orientation, 2 | 0.44 | 0.34 | 0.41 | ○ | 126 |

TABLE 3

| sample | alloy | cold rolling direction with respect to hot rolling direction (°) | orientation density of each of crystal orientations (random ratio): CR orientation | orientations other than CR orientation and orientation density | formability: equibiaxial deformation | plane strain deformation | uniaxial deformation | evaluation | proof stress (MPa) |
|---|---|---|---|---|---|---|---|---|---|
| C1 | alloy A | 0 | 8 | Cube orientation, 33 | 0.37 | 0.26 | 0.32 | X | 128 |
| C2 | alloy B | 0 | 6 | Cube orientation, 25 | 0.36 | 0.24 | 0.31 | X | 136 |
| C3 | alloy C | 0 | 7 | Cube orientation, 30 | 0.35 | 0.26 | 0.32 | X | 143 |
| C4 | alloy D | 0 | 4 | Cube orientation, 15 | 0.38 | 0.29 | 0.33 | X | 131 |
| C5 | alloy E | 0 | 9 | Cube orientation, 35 | 0.35 | 0.25 | 0.30 | X | 124 |
| C6 | alloy F | 0 | 5 | Cube orientation, 22 | 0.36 | 0.27 | 0.30 | X | 128 |
| C7 | alloy G | 0 | 5 | Cube orientation, 20 | 0.34 | 0.27 | 0.29 | X | 135 |
| C8 | alloy H | 0 | 6 | Cube orientation, 28 | 0.35 | 0.25 | 0.30 | X | 126 |
| C9 | alloy I | 0 | 7 | Cube orientation, 31 | 0.35 | 0.24 | 0.28 | X | 124 |
| C10 | alloy J | 0 | 8 | Cube orientation, 30 | 0.36 | 0.25 | 0.29 | X | 125 |

Next, for Samples E1 to E10 and Samples C1 to C10, a crystallite orientation distribution function (ODF) and formability were evaluated by the following method at 7 days after the final heat treatment. The results are collectively shown in Tables 2 and 3.

<Crystallite Orientation Distribution Function>

For the crystallite orientation distribution function (ODF), the ODF was determined according to three-dimensional orientation analysis from a pole figure measured by an X-ray diffractometer (RINT2000 manufactured by Rigaku Corporation) to determine the orientation density of each of crystal orientations. The ODF was calculated by a series expansion method proposed by Bunge, in which the expansion order of even-numbered terms was 22 and the expansion order of odd-numbered terms was 19. The orientation density was represented by a ratio of the orientation density of specific orientation to that of a sample having random orientation and denoted as a random ratio. Random strength Ir was calculated by means of the following equation from specimen sample strength Ic.

$$Ir[\alpha, \beta] = \sum_{\alpha=0}^{90} \sum_{\beta=0}^{360-\Delta s} Ic[\alpha, \beta] \times \cos\alpha \Big/ \sum_{\alpha=0}^{90} \sum_{\beta=0}^{360-\Delta s} \cos\alpha \qquad \text{[Equation 2]}$$

Wherein α and β are measured angles, and Δs is a step angle.

Tables 2 and 3 show the orientation density of CR orientation, and the orientation having orientation density representing the maximum value as compared to the orientations other than the CR orientation and the orientation density thereof ("orientation other than the CR orientation and orientation density thereof"). For example, in Sample E1, the orientation densities of the CR orientation and orientations other than the CR orientation are as follows. The CR orientation: 20; Cube orientation: 2; Goss orientation: 0; Brass orientation: 1; S orientation: 0; Copper orientation: 0; RW orientation: 0; and PP orientation: 1. Therefore, the Cube orientation having orientation density representing the maximum value as compared to the orientations other than the CR orientation, and 2 of the orientation density thereof were shown in the "orientation other than the CR orientation and orientation density thereof" concerning Sample E1 of Table 2.

<Formability>

The formability was evaluated by measuring the rupture limit strain in the equibiaxial deformation, the plane strain deformation, and the uniaxial deformation.

(Equibiaxial Deformation)

A blank having a transferred scribed circle with a diameter of 6.3 mm was used. A forming test was performed under a forming condition of a punch diameter of 50 mm, a forming speed of 2 mm/s and a blank size of 100 mm×100 mm, and the rupture limit strain in the equibiaxial deformation was then measured.

A plastic sheet having high-viscosity mineral oil applied on both surfaces thereof as a lubricant was inserted between the punch and the blank for use.

The rupture limit of 0.40 or more was decided to be accepted, and the rupture limit of less than 0.40 was decided to be rejected.

(Plane Strain Deformation)

The lubricant used for the method for measuring the rupture limit strain in the equibiaxial deformation was changed, and the plane strain deformation was performed by applying low-viscosity mineral oil onto the blank.

The rupture limit of 0.30 or more was decided to be accepted, and the rupture limit of less than 0.30 was decided to be rejected.

(Uniaxial Deformation)

JIS No. 5 test pieces having a transferred scribed circle with a diameter of 6.35 mm were used, and the rupture limit strain in the uniaxial deformation was measured by performing a tensile test.

The rupture limit of 0.40 or more was decided to be accepted, and the rupture limit of less than 0.40 was decided to be rejected.

(Evaluation)

The formability was decided to be accepted when all of the equibiaxial deformation, the plane strain deformation, and the uniaxial deformation were accepted (evaluation: ○). The formability was decided to be rejected when any one of the equibiaxial deformation, the plane strain deformation, and the uniaxial deformation was rejected (evaluation: x).

Proof stresses are collectively shown in Tables 2 and 3 as one example.

As known from Table 2, for the crystallo-graphic textures of Samples E1 to E10 as examples, the orientation density of the CR orientation was higher than that of any orientation other than the CR orientation. The orientation density of the CR orientation was 10 or more, and the orientation densities of all orientations other than the Cube orientation were 4 or less.

The above-described Samples E1 to E10 showed good results for formability.

Accordingly, it turns out that the present invention can enhance the rupture limit in the equibiaxial deformation, the plane strain deformation, and the uniaxial deformation to obtain the aluminum alloy sheet which is suitable for press forming.

For the crystallo-graphic textures of Samples C1 to C10 as comparative examples, the orientation showing the highest orientation density was the Cube orientation which was an orientation other than the CR orientation, and the orientation density thereof was 10 or more. Therefore, the rupture limit strain in all of the equibiaxial deformation, the plane strain deformation, and the uniaxial deformation was also low, and the formability was rejected.

Example 2

In this example, aluminum alloy sheets (Samples E11 to E14 and Sample C11 to C14) made of an Al—Mg alloy were manufactured as examples of the aluminum alloy sheets for press forming of the present invention and comparative examples. The examples illustrate one embodiment of the present invention, which should not be construed as limiting the present invention. Hereinafter, this will be described in detail.

A method for manufacturing the aluminum alloy sheet for press forming will be described.

First, alloys (Alloy K to Alloy N) having respective compositions shown in Table 4, in each of which the balance consisted of inevitable impurities and aluminum, were made into ingots by a semi-continuous casting process referred to as a DC casting process. The obtained ingots were homogenized at 480° C. for 6 hours and then cooled to room temperature.

TABLE 4

| | composition (mass %) | | | | | | | | | | |
|---|---|---|---|---|---|---|---|---|---|---|---|
| | Mg | Mn | Fe | Si | Cu | Cr | Zn | Zr | V | Ti | B |
| alloy K | 2.20 | 0.05 | 0.29 | 0.22 | — | 0.32 | — | — | — | 0.04 | 0.0006 |
| alloy L | 6.10 | — | 0.31 | 0.21 | 0.30 | | — | — | — | 0.05 | 0.0005 |
| alloy M | 4.50 | 0.95 | 0.36 | 0.38 | — | 0.21 | — | — | — | 0.04 | 0.0005 |
| alloy N | 4.60 | 0.80 | 0.15 | 0.12 | — | 0.15 | 0.35 | 0.18 | 0.04 | 0.03 | 0.0007 |

Next, the ingots were then reheated to 450° C. and hot rolling was started to obtain 3.0 mm-thick hot-rolled sheets. The finishing temperature of the hot rolling was 350° C. Subsequently, the hot-rolled sheets were cold-rolled in the 0° direction (arrow B) with respect to the hot rolling direction (arrow A) as shown in FIG. 1(*a*) or in the 90° direction (arrow D) with respect to the hot rolling direction (arrow C) as shown in FIG. 1(*b*) to obtain 1.0 mm-thick cold-rolled sheets. The cold-rolled sheets were further subjected to an annealing at 450° C. for 30 seconds. Thereby, the aluminum alloy sheets for press forming (Samples E11 to E14 and Samples C11 to C14) were obtained. Table 5 shows the types of alloys used and the cold rolling directions with respect to the hot rolling directions, for Samples E11 to E14 and Samples C11 to C14 described above.

TABLE 5

| sample | alloy | cold rolling direction with respect to hot rolling direction (°) | orientation density of each of crystal orientations (random ratio): CR orientation | orientations other than CR orientation and orientation density | formability: equibiaxial deformation | plane strain deformation | uniaxial deformation | evaluation | proof stress (MPa) |
|---|---|---|---|---|---|---|---|---|---|
| E11 | alloy K | 90 | 18 | Cube orientation, 3 | 0.45 | 0.35 | 0.42 | ○ | 95 |
| E12 | alloy L | 90 | 10 | Cube orientation, 2 | 0.42 | 0.31 | 0.40 | ○ | 116 |
| E13 | alloy M | 90 | 15 | Cube orientation, 4 | 0.43 | 0.32 | 0.41 | ○ | 165 |
| E14 | alloy N | 90 | 16 | Cube orientation, 2 | 0.41 | 0.30 | 0.40 | ○ | 145 |
| C11 | alloy K | 0 | 6 | Cube orientation, 16 | 0.35 | 0.25 | 0.30 | X | 96 |
| C12 | alloy L | 0 | 3 | Cube orientation, 8 | 0.36 | 0.26 | 0.34 | X | 118 |
| C13 | alloy M | 0 | 4 | Cube orientation, 10 | 0.32 | 0.23 | 0.29 | X | 167 |
| C14 | alloy N | 0 | 3 | Cube orientation, 9 | 0.33 | 0.22 | 0.28 | X | 148 |

Next, for Samples E11 to E14 and Samples C11 to C14, a crystallite orientation distribution function (ODF) and formability were evaluated in the same manner as Example 1 as described above. The results are collectively shown in Table 5.

As known from Table 5, for the crystallo-graphic textures of Samples E11 to E14 as examples, the orientation density of the CR orientation was higher than that of any orientation other than the CR orientation. The orientation density of the CR orientation was 10 or more, and the orientation densities of all orientations other than the Cube orientation were 4 or less. The above-described Samples E11 to E14 showed good results for formability. Accordingly, it turns out that the present invention can enhance the rupture limit in the equibiaxial deformation, the plane strain deformation, and the uniaxial deformation to obtain the aluminum alloy sheet which is suitable for press forming.

As known from Table 5, for the crystallo-graphic textures of Samples C11 to C14 as comparative examples, the orientation showing the highest orientation density was the Cube orientation which was an orientation other than the CR orientation. Therefore, the rupture limit strain in all of the equibiaxial deformation, the plane strain deformation, and the uniaxial deformation was also low, and the formability was rejected.

Example 3

In this example, aluminum alloy sheets (Samples E15 to E18 and Samples C15 to C18) made of an Al—Mn alloy were manufactured as examples of the aluminum alloy sheets for press forming of the present invention and comparative examples. The examples illustrate one embodiment of the present invention, which should not be construed as limiting the present invention. Hereinafter, this will be described in detail.

A method for manufacturing the aluminum alloy sheet for press forming will be described.

First, alloys (Alloy O to Alloy R) having respective compositions shown in Table 6, in each of which the balance consisted of inevitable impurities and aluminum, were made into ingots by a semi-continuous casting process referred to as a DC casting process. The obtained ingots were homogenized at 580° C. for 6 hours and then cooled to room temperature.

TABLE 6

| | composition (mass %) | | | | | | | | | | |
|---|---|---|---|---|---|---|---|---|---|---|---|
| | Mn | Mg | Si | Fe | Cu | Cr | Zn | Zr | V | Ti | B |
| alloy O | 0.34 | 0.32 | 0.12 | 0.15 | 0.14 | 0.18 | 0.37 | — | — | 0.03 | 0.0005 |
| alloy P | 1.40 | 0.03 | 0.55 | 0.62 | 0.15 | — | — | — | — | 0.04 | 0.0006 |
| alloy Q | 1.20 | 1.00 | 0.52 | 0.75 | 0.22 | — | 0.23 | — | 0.04 | 0.03 | 0.0006 |
| alloy R | 1.30 | — | 0.22 | 0.36 | — | — | — | 0.45 | — | 0.05 | 0.0007 |

Next, the ingots were reheated to 500° C. and hot rolling was started to obtain 3.0 mm-thick hot-rolled sheets. The finishing temperature of the hot rolling was 350° C. Subsequently, the hot-rolled sheets were cold-rolled in the 0° direction (arrow B) with respect to the hot rolling direction (arrow A) as shown in FIG. 1(*a*) or in the 90° direction (arrow D) with respect to the hot rolling direction (arrow C) as shown in FIG. 1(*b*) to obtain 1.0 mm-thick cold-rolled sheets. The cold-rolled sheets were further subjected to the annealing at 450° C. for 30 seconds. Thereby, the aluminum alloy sheets for press forming (Samples E15 to E18 and Samples C15 to C18) were obtained. Table 7 shows the types of alloys used and the cold rolling directions with respect to the hot rolling directions, for Samples E15 to E18 and Samples C15 to C18 described above.

TABLE 7

| sample | alloy | cold rolling direction with respect to hot rolling direction (°) | orientation density of each of crystal orientations (random ratio): CR orientation | orientations other than CR orientation and orientation density | formability: equibiaxial deformation | plane strain deformation | uniaxial deformation | evaluation | proof stress (MPa) |
|---|---|---|---|---|---|---|---|---|---|
| E15 | alloy O | 90 | 14 | Cube orientation, 3 | 0.43 | 0.33 | 0.41 | ○ | 45 |
| E16 | alloy P | 90 | 19 | Cube orientation, 2 | 0.46 | 0.36 | 0.43 | ○ | 43 |
| E17 | alloy Q | 90 | 11 | Cube orientation, 2 | 0.40 | 0.31 | 0.40 | ○ | 75 |
| E18 | alloy R | 90 | 12 | Cube orientation, 2 | 0.41 | 0.31 | 0.40 | ○ | 50 |
| C15 | alloy O | 0 | 4 | Cube orientation, 10 | 0.35 | 0.25 | 0.32 | X | 42 |
| C16 | alloy P | 0 | 3 | Cube orientation, 15 | 0.37 | 0.27 | 0.34 | X | 44 |
| C17 | alloy Q | 0 | 2 | Cube orientation, 6 | 0.32 | 0.21 | 0.28 | X | 74 |
| C18 | alloy R | 0 | 2 | Cube orientation, 8 | 0.35 | 0.25 | 0.31 | X | 52 |

Next, for Samples E15 to E18 and Samples C15 to C18, a crystallite orientation distribution function (ODF) and formability were evaluated in the same manner as Example 1 as described above. The results are collectively shown in Table 7.

As known from Table 7, for the crystallo-graphic textures of Samples E15 to E18 as examples, the orientation density of the CR orientation was higher than that of any orientation other than the CR orientation. The orientation density of the CR orientation was 10 or more, and the orientation densities of all orientations other than the Cube orientation were 3 or less. The above-described Samples E15 to E18 showed good results for formability. Accordingly, it turns out that the present invention can enhance the rupture limit in the equibiaxial deformation, the plane strain deformation, and the uniaxial deformation to obtain the aluminum alloy sheet which is suitable for press forming.

As known from Table 7, for the crystallo-graphic textures of Samples C15 to C18 as comparative examples, the orientation showing the highest orientation density was the Cube orientation which was an orientation other than the CR orientation. Therefore, the rupture limit strain in all of the equibiaxial deformation, the plane strain deformation, and the uniaxial deformation was also low, and the formability was rejected.

The invention claimed is:

1. An aluminum alloy sheet, comprising a crystallographic texture, wherein an orientation density of CR orientation, {001}<520>, is higher than an orientation density of any orientation other than the CR orientation, wherein the orientation density of the CR orientation is 10 or more, wherein orientation densities of all orientations other than the CR orientation are less than 10, and wherein the aluminum alloy sheet comprises an Al—Mg—Si alloy.

2. An aluminum alloy sheet, comprising a crystallographic texture, wherein an orientation density of CR orientation, {001}<520>, is higher than an orientation density of any orientation other than the CR orientation, wherein the orientation density of the CR orientation is 10 or more, wherein orientation densities of all orientations other than the CR orientation are less than 10, and wherein the aluminum alloy sheet comprises an Al—Mg alloy.

3. An aluminum alloy sheet, comprising a crystallographic texture, wherein an orientation density of CR orientation, {001}<520>, is higher than an orientation density of any orientation other than the CR orientation, wherein the orientation density of the CR orientation is 10 or more, wherein the orientation densities of all orientations other than the CR orientation are less than 10, and wherein the aluminum alloy sheet comprises an Al—Mn alloy.

4. The aluminum alloy sheet, comprising, in mass %, 0.2% to 2.0% of Si; 0.2% to 1.5% of Mg, 1.0% or less of Cu, 0.5% or less of Zn, 0.5% or less of Fe, 0.3% or less of Mn, 0.3% or less of Cr, 0.2% or less of V, 0.15% or less of Zr, 0.1% or less of Ti, 0.005% or less of B, inevitable impurities and aluminum.

5. The aluminum alloy sheet, comprising, in mass %, 1.5 to 6.5% of Mg, 1.5% or less of Mn, 0.7% or less of Fe, 0.5% or less of Si, 0.5% or less of Cu, 0.5% or less of Cr, 0.4% or less of Zn, 0.3% or less of Zr, 0.2% or less of V, 0.2% or less of Ti, 0.05% or less of B, inevitable impurities and aluminum.

6. The aluminum alloy sheet for press forming, comprising, in mass %; 0.3 to 2.0% of Mn, 1.5% or less of Mg, 1.0% or less of Si, 1.0% or less of Fe, 0.5% or less of Cu, 0.5% or less of Cr, 0.5% or less of Zn, 0.5% or less of Zr, 0.2% or less of V, 0.2% or less of Ti and 0.05% or less of B, inevitable impurities and aluminum.

* * * * *